United States Patent [19]

Tsubai et al.

[11] Patent Number: 5,057,395

[45] Date of Patent: Oct. 15, 1991

[54] SILVER COMPLEX DIFFUSION TRANSFER PROCESS

[75] Inventors: Yasuo Tsubai; Susumu Baba; Akio Yoshida, all of Nagaokakyo, Japan

[73] Assignee: Mitsubishi Paper Mills Limited, Tokyo, Japan

[21] Appl. No.: 437,901

[22] Filed: Nov. 17, 1989

[30] Foreign Application Priority Data

Jun. 19, 1989 [JP] Japan ..... 1-156217

[51] Int. Cl.[5] ..... G03C 5/54

[52] U.S. Cl. ..... 430/248; 430/230; 430/233; 430/232; 430/244; 430/249; 430/251; 430/965

[58] Field of Search ..... 430/230, 233, 248, 249, 430/251, 244, 965, 232

[56] References Cited

U.S. PATENT DOCUMENTS

| | | | |
|---|---|---|---|
| 3,576,629 | 4/1971 | Futaki et al. | 430/233 |
| 4,302,526 | 11/1981 | Kohmura et al. | 430/230 |
| 4,362,811 | 12/1982 | Iguchi et al. | 430/251 |
| 4,436,805 | 3/1984 | Iguchi et al. | 430/233 |
| 4,562,140 | 12/1985 | Kohmura et al. | 430/230 |
| 4,605,609 | 8/1986 | Okazaki et al. | 430/233 |
| 4,632,896 | 12/1986 | Tsubai et al. | 430/249 |

*Primary Examiner*—Richard L. Schilling
*Attorney, Agent, or Firm*—Cushman, Darby & Cushman

[57] ABSTRACT

Disclosed is a silver complex diffusion transfer process which comprises processing a photosensitve material comprising a support and at least a silver halide emulsion layer provided thereon and an image receiving material comprising a support and at least an image receiving layer provided thereon which are brought into close contact with each other in a developing processing solution. This process is characterized in that said image receiving layer has 1–3 g/m$^2$ of a hydrophilic colloid at least 80% by weight of which is gelatin; total amount of hydrophilic colloid present on the emulsion layer side of the photosensitive material is 5–8 g/m$^2$; when the materials are immersed in a 0.1N aqueous sodium hydroxide solution at 20° C. for 1 minute, amount of absorbed solution per 1 g of hydrophilic colloid is 3.5–7 ml of the emulsion layer side of the photosensitive material and is 2–4 ml on the image receiving layer side of the image receiving material and the processing of the materials in the developing processing solution is carried out in the presence of at least one of 1-aryl or aralkyl substiuted-5-mercaptotetrazoles and at least one of 4-amino-3-unsubstituted or $C_{1-3}$alkyl substituted-5-mercapto-1,2,4-triazoles.

10 Claims, No Drawings

SILVER COMPLEX DIFFUSION TRANSFER PROCESS

BACKGROUND OF THE INVENTION

The present invention relates to a silver complex diffusion transfer process.

Theory of silver complex diffusion transfer process (hereinafter referred to as DTR process) is mentioned in U.S. Pat. No. 2,352,014 and other many patents and literatures and is well known. That is, in DTR process, silver complex salt is transferred imagewise from silver halide emulsion layer to image receiving layer by diffusion and in many cases is converted to silver image in the presence of physical development nuclei. For this purpose, imagewise exposed silver halide emulsion layer is in close contact with or is brought into close contact with an image receiving layer in the presence of a developing agent and a silver halide solvent to convert unexposed silver halide to soluble silver complex salt. The silver halide in the exposed portion of silver halide emulsion layer is developed to silver and hence is no longer dissolved and so cannot diffuse. In the unexposed portion of silver halide emulsion layer, silver halide is converted to soluble silver complex salt and is transferred to image receiving layer, where it forms silver image normally in the presence of development nuclei.

DTR process can be applied to reproduction of documents, production of lithographic printing plates, production of block copies and instant photography.

Especially for reproduction of documents and production of block copies, a negative material having a silver halide emulsion layer and a positive material having an image receiving layer containing physical development nuclei are brought into close contact with each other normally in a DTR processing solution containing a silver complex salt forming agent to form silver image on the image receiving layer of positive material.

The resulting silver image is required to have pure black color or bluish black color and besides must have sufficiently high density.

Furthermore, it is important that the silver image is high in contrast and sharpness and good in image reproducibility and besides high transfer speed is desired.

It is further necessary that good quality of positive material is not greatly depending on processing conditions (such as time and temperature).

In view of the theory of DTR process, it is easily conjectured that the process of image formation is greatly influenced by processing conditions, especially processing temperature and processing speed and this is well known in this field.

General examples of change in characteristics caused by change in processing circumstances, especially in processing temperature and running condition are enumerated below.

1. Changes in sensitivity, tone and density (reflection density and transmission density).
2. Easy occurrence of stain on image receiving sheet (due to formation of fine particle silver colloid).
3. Reduction of ability to form fine images such as fine lines and fine dots with increase of processing temperature or running speed.

Until now, many proposals have been made for solving these problems in respect of negative material and processing solution as disclosed in U.S. Pat. Nos. 4,302,526, 4,362,811, 4,436,805, 4,605,609, and 4,632,896, but these have not yet been satisfactory from all-round aspects. It is considered that this is because DTR process is based on the subtle balance between chemical development and dissolution, diffusion and physical development and control thereof is difficult.

In addition, the above-mentioned change of characteristics is apt to become conspicuous after continuous use of processing solution for a long time (running processing).

Generally, image forming system according to DTR process employs very simple process. For example, processor used is formed of a tray for holding transfer developer, squeeze rollers for bringing negative sheet and positive sheet into close contact with each other and a motor for rotating the squeese rollers.

In any way, it is the positive material which utilizes the silver image obtained by this simple process and the positive material must be excellent in image characteristics and physical characteristics. For example, in order for the image receiving layer of positive material having a high mechanical strength, there is a method of increasing hardness and for this purpose it was necessary to use gelatin as main portion of binder in image receiving layer.

However, even if such positive material having image receiving layer is mainly composed of gelatin, when DTR process is carried out, it is difficult to obtain silver image of high maximum density, high contrast, high fine line reproducibility and of pure black tone, and this is extremely difficult when processing temperature is low or processing solution is exhausted. It has also been found that this defect becomes severer when a negative material containing a developing agent such as hydroquinone in at least one hydrophilic colloid layer is used.

SUMMARY OF THE INVENTION

An object of the present invention is to provide a silver complex diffusion transfer process according to which silver image of good characteristics can be continually and stably obtained using a positive material having high mechanical strength.

Another object of the present invention will become clear from the following disclosures.

The above objects have been attained by a silver complex diffusion transfer process which comprises processing a photosensitive material comprising a support and at least a silver halide emulsion layer provided thereon and an image receiving material comprising a support and at least an image receiving layer provided thereon which are brought into close contact with each other in a developing processing solution, characterized in that said image receiving layer has 1–3 g/m$^2$ of a hydrophilic colloid at least 80% by weight of which is gelatin; total amount of hydrophilic colloid on the emulsion layer side of the photosensitive material is 5–8 g/m$^2$; when the materials are immersed in a 0.1 N aqueous sodium hydroxide solution at 20° C. for 1 minute, amount of the solution absorbed in the layer on the emulsion layer side is 3.5–7 ml per 1 g of hydrophilic colloid and amount of the solution absorbed in the layer on the image receiving layer side of the image receiving material is 2–4 ml per 1 g of hydrophilic colloid and the processing of the materials in the developing solution is carried out in the presence of at least one 1-aryl or aralkyl substituted-5-mercaptotetrazole and at least one 4-amino-3-unsubstituted or $C_{1-3}$alkyl substituted-5-mercapto-1,2,4-triazole.

DESCRIPTION OF THE INVENTION

The present invention will be explained in detail.

Preferred construction of the photosensitive material (negative material) for diffusion transfer process used in the present invention comprises a polyolefin resin coated paper support (RC paper) and, provided thereon, at least an antihalation undercoat layer and a silver halide emulsion layer which is disclosed, for example, in the above-mentioned U.S. Pat. No. 4,302,526.

It is preferred that the silver halide emulsion layer contains 1.5–3 g/m$^2$ of silver halide in terms of silver nitrate and 1–3 g/m$^2$ of hydrophilic colloid and the undercoat layer contains 2–6 g/m$^2$ of hydrophilic colloid. Total amount of hydrophilic colloid on the silver halide emulsion layer side of the support is 5–8 g/m$^2$, preferably 5.5–8 g/m$^2$.

If necessary, a protective layer, a peeling layer, a protective layer and the like may also be provided.

When the photosensitive material for diffusion transfer process used in the present invention contains a hydroxybenzene developing agent, the effect of the present invention can be more effectively exhibited. It is considered that this is because activation of developing agent is slow when processing temperature is low or processing solution is exhausted.

The hydroxybenzene developing agent used in the present invention includes, for example, hydroquinones such as hydroquinone, methylhydroquinone, and chlorohydroquinone and polyhydroxybenzene compounds such as catechol and pyrogallol. This developing agent is preferably combined with pyrazolidone developing agents such as 1-phenyl-3-pyrazolidone, 5-methyl-1-phenyl-3-pyrazolidone, 1-(3-tolyl)-3-pyrazolidone and 4,4-dimethyl-1-phenyl-3-pyrazolidone.

Content of hydroxybenzene developing agent is generally 0.3–3 g/m$^2$, preferably 0.5–2 g/m$^2$. The developing agent is most preferably contained in undercoat layer, but a part or the whole thereof may be contained in silver halide emulsion layer.

The 3-pyrazolidones may be contained in an amount of 0.05–0.5 g/m$^2$ in optional layers.

The silver halide emulsion layer, undercoat layer, backing layer, and the like of the negative material according to the present invention contain at least one hydrophilic colloid substances, for example, gelatin, gelatin derivatives such as phthalated gelatin, cellulose derivatives such as carboxymethylcellulose and hydroxymethylcellulose, and hydrophilic polymers such as dextrin, soluble starch, polyvinyl alcohol and polystyrenesulfonic acid.

These hydrophilic colloid layers are hardened with at least one hardener Examples of the hardener are aldehyde hardeners such as formalin and glyoxal, inorganic hardeners such as chrome alum and potassium alum, and non-aldehyde hardeners such as active halogen type, active olefin type, epoxide type and aziridine type. The active halogen type hardeners include those which are disclosed in belgian Patent Nos 579,739 and 598,272, West German Patent No. 1,130,283, West German Patent Laid-Open Application No. 1,900,791, U.S. Pat. Nos. 2,169,513, 2,732,303, 2,976,150, 2,976,152, 3,106,468, 3,542,549, 3,549,377, 3,645,743, 3,689,274, and 3,701,664, British Patent Nos. 941,998, 974,723, 990,275, 997,635, 1,022,656, 1,072,008, and 1,167,207, Japanese Patent Kokoku Nos. 39-16928, and 47-33830.

The active olefin type hardeners include those which are disclosed in West German Patent Nos. 872,153, 1,090,427, 1,100,942, 1,105,272, and 1,622,260, U.S. Pat. Nos. 2,579,871, 3,255,000, 3,490,911, 3,640,720, 3,642,486, 3,687,707, and 3,749,573, British Patent Nos. 994,869, 1,054,123, 1,115,164, 1,158,263, 1,182,389, and 1,183,648, Japanese Patent Kokoku Nos. 44-23238, 47-8736, and 47-25373.

The epoxide type hardeners include those which are disclosed in Belgian Patent No. 578,751, West German Patent Nos. 1,085,663, 1,091,322, and 1,095,113, U.S. Pat. Nos. 2,726,162, 3,047,394, 3,091,513, and 3,179,517, and Japanese Patent Kokoku No. 34-7133.

The aziridine type hardeners include those which are disclosed in Belgian Patent No. 575,440, West German Patent No. 1,081,169, U.S. Pat. Nos. 2,327,760, 2,390,165, 2,950,197, 2,964,404, 2,983,611, 3,017,280, 3,220,848, and 3,549,378, British Patent No. 797,321, Italian Patent No. 572,862, Japanese Patent Kokoku Nos 33-4212, and 37-8790.

Amount of hardeners added may be changed within the range of about 0.01–1.0 mmol per 1 g of gelatin.

The above-mentioned kind and amount of the hardeners are one of main factors which govern the amount of the absorbed solution on the silver halide emulsion side, although the amount of absorbed solution is also influenced by amount and kind of gelatin (for example, lime treated gelatin, acid treated gelatin, low calcium content gelatin as disclosed in U.S. Pat. No. 4,605,609), pH of layers, content of hydroxybenzene developing agent, additives, coating and drying conditions, and heating conditions of coat.

The negative material of the present invention is adjusted so that when the hydrophilic colloid layers on the silver halide emulsion layer side is immersed in a 0.1 N aqueous sodium hydroxide solution at 20° C. for 1 minute, amount of the solution absorbed by the layers is within the range of 3.5–7 ml, preferably 4–6 ml per 1 g of hydrophilic colloid.

The image receiving material (positive material) used in the present invention has at least one image receiving layer on a support and may additionally have an undercoat layer, over layer, and the like. Such image receiving layer and other layers provided, if necessary, comprise the hydrophilic colloid as referred to for the photosensitive material (negative material) and at least the image receiving layer contains the hydrophilic colloid in an amount of 1–3 g/m$^2$ and at least 80% by weight of the hydrophilic colloid is gelatin. Gelatin may be of any kinds as mentioned above and is contained preferably in an amount of 1–2.5 g/m$^2$. When two or more layers are provided, it is also preferred that total amount of hydrophilic colloid on the image receiving layer side is 1–3 g/m$^2$.

The hydrophilic colloid layer on the image receiving layer side is hardened with hardeners as mentioned for negative material. As in the case of negative material, amount of hardener varies depending on other conditions, but the hardener is added in such amount that the amount of absorbed solution in the above mentioned test method referred to for the negative material is within the range of 2–4 ml per 1 g of hydrophilic colloid and less than the amount of absorbed solution in negative material.

By carrying out DTR process by combining the above-mentioned negative material and positive material, silver image having better photographic characteristics than those obtained by combination of other materials is obtained without damaging the superior mechanical strength of the positive material through running processing. Furthermore, in the above DTR process which uses a positive material having an image receiving layer mainly composed of gelatin, color tone, density and contrast of silver image especially when the processing is carried out at low temperature are improved by using two kinds of mercapto compounds. 1-Phenyl-5-mercaptotetrazole is well known as a toning agent for blackening the transfer silver image as mentioned in the above-mentioned patent specification. However, it is difficult to obtain silver image of pure black color in the above DTR process by using only the mercaptotetrazole.

On the other hand, U.S. Pat. No. 3,576,629 states that 4-amino-5-mercapto-1,2,4-triazole has remarkable effect to accelerate transfer, but has no effect to improve color tone.

Unexpectedly, it has been found that in use of the negative material and the positive material, when the above mercaptotetrazoles and 4-amino-5-mercapto-1,2,4triazoles are used in combination, silver image of pure black color which cannot be obtained by single use of them can be obtained. This synergistic effect is conspicuous when a negative material containing a developing agent is used or processing temperature with developing solution is low, namely, lower than 15° C.

The mercaptotetrazoles used in the present invention have aryl group or aralkyl group (such as benzyl group) at 1-position and these aryl group and aralkyl group may be substituted with an alkyl group such as methyl, ethyl, propyl or the like, an alkoxy group such as methoxy, ethoxy, or the like, a halogen atom such as chlorine, bromine or the like, an acyl group such as acetyl, propionyl, or the like, an acylamide group such as acetamido, propionylamido, or the like.

The mercaptotriazole used in the present invention can be shown by the following formula.

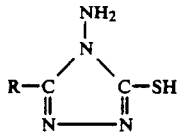

(wherein R represents a hydrogen atom or an alkyl group of 1-3 carbon atoms).

The mercaptotetrazole may be contained in either one of negative material, positive material or processing solution, but preferably is contained in two or more of them. It is contained in an amount of 5-500 mg/liter, preferably 10-300 mg/liter when contained in processing solution and in an amount of 0.1-100 mg/m$^2$, preferably 0.2-50 mg/m$^2$ when contained in negative material and positive material.

The mercaptotriazole may also be contained in either one of negative material, positive material or processing solution, but is preferably contained in at least one of positive material and processing solution. It is contained in an amount of 10-1000 mg/liter, preferably 20-500 mg/liter when contained in processing solution and is contained in an amount of 1-100 mg/m$^2$ when contained in positive material.

Proportion of the mercaptotetrazole and mercaptotriazole varies depending on places in which they are contained and other conditions and can be determined based on the above-mentioned amounts thereof.

The silver halide used in the present invention may be any of, for example, silver chloride, silver bromide, silver chlorobromide or these silver halides combined with silver iodide.

The silver halide used in the present invention is preferably silver chlorobromide or silver chloroiodobromide containing 1-5 mol% of bromide.

Silver halide containing less than 1 mol% of bromide gives low density and silver halide containing more than 5 mol% of bromide causes inferior running processing characteristics and reduction of density and contrast with use of exhausted processing solution In the present invention pH of the silver halide emulsion layer and undercoat layer is preferably 4.5 or less, which affords photosensitive materials for diffusion transfer excellent in stability with time (shelf stability) and less in unevenness in dots.

Silver halide emulsion may be spectrally sensitized to blue, green and red with sensitizing dyes such as merocyanine, cyanine dyes and the like.

Furthermore, the silver halide emulsion may be chemically sensitized with various sensitizing agents, for example, sulfur sensitizing agents (such as hypo, thiourea, and gelatin containing unstable sulfur), noble metal sensitizing agents (such as gold chloride, gold thiocyanate, ammonium chloroplatinate, silver nitrate, silver chloride, palladium salts, rhodium salts, iridium salts and ruthenium salts), polyalkylenepolyamine compounds mentioned in U.S. Pat. No. 2,518,698, iminoamino-methanesulfinic acid mentioned in German Patent No. 1,020,864, and reduction sensitizing agents (such as stannous chloride).

The backing layer which is desirably provided on backside of support contains hydrophilic colloid in an amount necessary to keep balance in curling with the photosensitive layer side. The amount depends on total amount of hydrophilic colloid on the photosensitive layer side and amount of white inorganic pigment.

When the silver halide emulsion layer is combined with an antihalation undercoat layer containing a black pigment, image reproducibility can be improved.

When the silver halide emulsion layer is combined with an antihalation undercoat layer containing a white pigment, image reproducibility can be improved.

Also when the silver halide emulsion layer is combined with an antihalation undercoat layer in which the black pigment and the white pigment are used in combination, image reproducibility can be improved.

The constituting elements of the diffusion transfer negative material and positive material of the present invention may further contain various additives as exemplified below.

Antifoggants and stabilizers such as mercapto compounds other than those which are mentioned above and tetrazaindene, surface active agents, e.g. anionic compounds such as saponin, sodium alkylbenzenesulfonate, sulfosuccinic acid esters, and alkylarylsulfonates as disclosed in U.S. Pat. No. 2,600,831 and amphoteric compounds as disclosed in U.S. Pat. No. 3,133,816, and besides, wetting agents such as wax, polyol compounds, glycerides of higher fatty acids and esters of higher alcohols, mordants such as N-guanylhydrazone compounds, quaternary onium compounds and tertiary amine compounds, antistatic agents such as diacetyl cellulose, styreneperfluoroalkylene sodium maleate copolymer, and alkali salts of reaction products of styrene-maleic anhydride copolymer with p-aminobenzenesulfonic acid, matting agents such as polymethacrylic acid esters, polystyrene, and colloidal silica, film property modifiers such as acrylic acid esters and various latexes, thickening agents such as styrene-maleic acid copolymer and those disclosed in Japanese Patent Kokoku No. 36-21574, antioxidants, developing agents, and pH adjustors.

A plurality of the hydrophilic colloid layers may be coated separately or simultaneously. Coating method is not critical and any known methods may be employed.

The image receiving layer of positive material contains well known physical development nuclei such as heavy metals and sulfides thereof.

Supports used in negative material and positive material are any of commonly used supports Examples thereof are paper, glass, films such as cellulose acetate film, polyvinylacetal film, polystyrene film, and polyethylene tetraphthalate film, a metallic support coated with paper on both sides, and a paper support coated on one or both sides with an α-olefin polymer such as polyethylene.

Processing solution used for diffusion transfer process may contain alkaline materials such as sodium hydroxide, potassium hydroxide, lithium hydroxide, and tribasic sodium phosphate; silver halide solvents such as sodium thiosulfate, ammonium thiocyanate, cyclic imide compounds, and thiosalicylic acid; preservatives such as sodium sulfite; thickening agents such as hydroxyethyl cellulose and carboxymethyl cellulose; antifoggants such as potassium bromide and benzotriazole; development modifiers such as polyoxyalkylene compounds and onium compounds; developing agents such as hydroquinone and 1-phenyl-3-pyrazolidone; and alkanol amines.

The present invention will be illustrated by the following nonlimiting examples.

EXAMPLE 1

An aqueous solution of sodium chloride and potassium bromide and an aqueous solution of silver nitrate were simultaneously added at a rate of 5 ml/min to an aqueous solution of inert gelatin kept at 60° C. with vigorous stirring to obtain a silver chlorobromide emulsion containing 2% of bromide. The silver halide grains were in cubic form in habit and have an average grain side of 0.32 μ and 90% by weight or more of the total grains were included within ±30% of the average grain size.

The emulsion was precipitated and washed with water and redissolved and then was subjected to sulfur sensitization and gold sensitization with sodium thiosulfate and potassium chloroaurate. To the resulting emulsion was added a sensitizing dye to carry out orthochromatic sensitization and a surface active agent was added thereto to make up emulsion.

On one side of a paper support of 110 g/m² coated with polyethylene on both sides was provided an undercoat layer comprising 4 g/m² of gelatin containing 0.5 g/m² of carbon black, 0.8 g/m² of hydroquinone and 0.2 g/m² of 1-phenyl-4,4-dimethyl-3-pyrazolidone as an antihalation layer and on this undercoat layer was provided an emulsion layer comprising the above obtained emulsion so that amount of coated silver was 1.3 g/m², amount of coated gelatin was 2.0 g/m² and amount of hydroquinone was 0.3 g/m².

The undercoat layer and the emulsion layer were both adjusted to pH=4.0. On the opposite side (back side) of the support was provided a gelatin layer (containing silica particles) necessary to control curling and having a pH of 4.5.

After drying, the samples were heated for 6 days under the conditions of 35° C. RH 60%.

All of the gelatin layers contained 2,4-dichloro-6-hydroxy-S-triazine (Na salt) as a hardener. When the sample after the heating referred to above was immersed in a 0.1 N aqueous NaOH solution at 20° C. for 1 minute, amount of the solution absorbed in the undercoat layer and the emulsion layer was 5.2 ml/1 g/m² gelatin. (Negative material A).

On the other hand, a positive material was prepared by providing an image receiving layer comprising 2.0 g/m² of gelatin containing palladium sulfide nuclei on a polyester film of 100 μm thick which had been subjected to subbing treatment. The image receiving layer was hardened with formalin and had the amount of absorbed solution of 2.9 ml/1 g gelatin according to the abovementioned test. (Positive material A).

Positive materials B-F were prepared in the same manner as above except that mercapto compound as shown in the following table was contained in the image receiving layer of Positive material A. Content of the mercapto compound was in mg/m².

| Positive material | B | C | D | E | F |
|---|---|---|---|---|---|
| 1-Phenyl-5-mercaptotetrazole | 20 | — | — | 10 | 10 |
| 4-Amino-5-mercapto-1,2,4-triazole | — | 20 | — | 10 | — |
| 4-Amino-3-phenyl-5-mercapto-1,2,4-triazole | — | — | 20 | — | 10 |

Negative material A was exposed through a wedge which differed stepwise in density by 0.05 each and was brought into close contact with positive materials A-F and passed through an ordinary processor having the following diffusion transfer processing solution and after 60 seconds, the negative and the positive materials were separated from each other. Processing temperature was 10° C. and 20° C.

| Deffusion transfer processing solution | |
|---|---|
| EDTA | 1 g |
| Anhydrous sodium sulfite | 60 g |
| Sodium thiosulfate ($5H_2O$) | 15 g |
| Potassium bromide | 1 g |
| N-methylethanolamine | 40 ml |
| N-methyldiethanolamine | 40 ml |
| Water to make up totally one liter | |

Maximum transmission density ($D_T$) and color tone (evaluated by five grades with pure black color being 5 and considerable brown color being 1) of the resulting silver image are shown in Table 1.

TABLE 1

| | Processing temperature | | | |
|---|---|---|---|---|
| | 10° C. | | 20° C. | |
| | $D_T$ | Color tone | $D_T$ | Color tone |
| Positive material A | 3.0 | 1 | 3.3 | 1 |
| Positive material B | 2.5 | 3 | 3.0 | 4 |
| Positive material C | 3.4 | 1 | 3.8 | 1 |
| Positive material D | 2.8 | 2 | 3.2 | 2 |
| Positive material E | 3.3 | 5 | 3.5 | 5 |
| Positive | 2.6 | 3 | 3.0 | 4 |

TABLE 1-continued

| | Processing temperature | | | |
|---|---|---|---|---|
| | 10° C. | | 20° C. | |
| | $D_T$ | Color tone | $D_T$ | Color tone |
| material F | | | | |

It can be seen that DTR process according to the present invention which used positive material E was able to produce silver image of high maximum density and of pure black not only by processing at normal temperature, but by processing at low temperature.

EXAMPLE 2

Negative materials B–E were prepared by changing negative material A in Example 1 as shown in the following table.

| Negative materials | |
|---|---|
| B | Amount of gelatin in the undercoat layer was changed to 2 g/m$^2$. |
| C | Amount of gelatin in the undercoat layer was changed to 8 g/m$^2$. |
| D | Amount of hardener was increased so that amount of absorbed solution was 2.4 ml. |
| E | Amount of hardener was increased so that amount of absorbed solution was 8.1 ml. |

Negative materials A–E were combined with positive material A of Example 1 and were processed in the same manner as in Example 1. The processing solution was of the following formulation and fresh solution and model exhausted solution adjusted to pH 10.3 with sulfuric acid were used. Processing temperature was 15° C.

| Diffusion transfer processing solution. | |
|---|---|
| EDTA | 1 g |
| Anhydrous sodium sulfite | 60 g |
| Sodium thiosulfate ($5H_2O$) | 18 g |
| Potassium bromide | 1 g |
| Sodium tertiary phosphate ($12H_2O$) | 40 g |
| N-methylethanolamine | 45 ml |
| N-methldiethanolamine | 45 ml |
| 1-Phenyl-5-mercaptotetrazole | 0.2 g |
| Water to make up totally 1 liter. | |

The results are shown in Table 2. L is a difference between logarithm of relative exposure quantity at minimum density +0.02 and logarithm of relative exposure quantity at a density of 2.0. The smaller value means higher contrast.

TABLE 2

| | Fresh processing solution | | | Model exhaust processing solution | | |
|---|---|---|---|---|---|---|
| Negative material | $D_T$ | L | Color tone | $D_T$ | L | Color tone |
| A | 3.2 | 0.31 | 5 | 3.0 | 0.34 | 4 |
| B | 3.0 | 0.31 | 4 | 2.4 | 0.35 | 3 |
| C | 3.1 | 0.33 | 5 | 1.8 | 0.67 | 4 |
| D | 2.8 | 0.32 | 4 | 2.5 | 0.36 | 3 |
| E | 3.0 | 0.32 | 5 | 2.1 | 0.58 | 4 |

It can be seen that the DTR process according to the present invention which used negative material A provides good photographic characteristics in running processing, too.

EXAMPLE 3

Positive materials G and H were prepared by changing positive material E in Example 1 as shown in the following table.

| Positive material | |
|---|---|
| G | Amount of gelatin in the image receiving layer was changed to 4 g/m$^2$. |
| H | ⅓ of gelatin in the image receiving layer was replaced with a reaction product with heat of polyvinyl alcohol and ethylene-maleic anhydride copolymer (amount of absorbed solution per 1 g of binder was 3.4 ml). |

The materials were tested in accordance with Example 2 using negative material A and a processing solution of Example 2 to which was added 0.5 g/liter of 4-amino-3-methyl-5-mercapto-1,2,4-triazole.

The results are shown in Table 3.

TABLE 3

| | Fresh processing solution | | | Model exhausted processing solution | | |
|---|---|---|---|---|---|---|
| Negative material | $D_T$ | L | Color tone | $D_T$ | L | Color tone |
| E | 3.4 | 0.31 | 5 | 3.1 | 0.34 | 4 |
| G | 3.5 | 0.32 | 4 | 2.6 | 0.52 | 3 |
| H | 3.8 | 0.30 | 5 | 3.2 | 0.37 | 4 |

It can be seen that the DTR process according to the present invention which used positive material E provided good characteristics with less change in photographic characteristics even in running processing. On the other hand, positive material H had the problem that the image receiving layer was apt to flaw by washing with water after development processing.

EXAMPLE 4

Example 2 was repeated except that 1-phenyl-5-mercaptotetrazole of the positive material was replaced with the same amount of 1-benzyl-5-mercaptotetrazole. The results were similar to those of Example 2.

What is claimed is:

1. A silver complex diffusion transfer process which comprises imagewise exposing a photosensitive material comprising a support and at least a silver halide emulsion layer provided thereon and then developing it with a processing solution in the presence of a developing agent and a solvent for silver halide to transfer the thus produced imagewise silver complex to an image receiving material comprising a support and at least an image receiving layer containing physical development nuclei, wherein said image receiving layer has 1–3 g/m$^2$ of a hydrophilic colloid at least 80% by weight of which is gelatin; total amount of hydrophilic colloid present on the emulsion layer side of the photosensitive material is 5–8 g/m$^2$; when the materials are immersed in a 0.1 N aqueous sodium hydroxide solution at 200° C. for 1 minute, amount of the solution absorbed in the layer on the emulsion layer side of the photosensitive material is 3.5–7 ml per 1 g of hydrophilic colloid and amount of the solution absorbed in the layer on the image receiving layer side of the image receiving material is 2–4 ml per 1 g of hydrophilic colloid; and the processing of the materials in the developing processing solution is carried out in the presence of at least one 1-aryl or aralkyl substituted-5-mercaptotetrazole and at least one 4-amino-3-unsubstituted or $C_{1-3}$ alkyl substituted-5-mercapto-1,2,4-triazole.

2. The process according to claim 1, wherein the mercaptotriazole have the following formula:

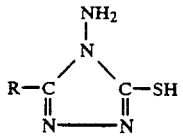

wherein R represents a hydrogen atom or an alkyl group of 1–3 carbon atoms.

3. The process according to claim 1, wherein the photosensitive material and the image receiving material contain a hardener.

4. The process according to claim 1, wherein the mercaptotetrazole and the mercaptotriazole are contained in at least one of the photosensitive material, the image receiving material and the processing solution.

5. The process according to claim 1, wherein the photosensitive material contains a hydroxybenzene developing agent.

6. The process according to claim 1, wherein the photosensitive material has an undercoat layer containing 2–6 $g/m^2$ of gelatin and the emulsion layer contains 1–3 $g/m^2$ of gelatin.

7. The process according to claim 1, wherein amount of the solution absorbed in the layer of the photosensitive material is larger than that of the solution absorbed in the layer of the image receiving material.

8. The process according to claim 1, wherein the mercaptotetrazole is contained in at least one of the photosensitive material, the image receiving material and the developing processing solution.

9. The process according to claim 1, wherein the mercaptotriazole is contained in at least-one of the image receiving material and the developing processing solution.

10. The process according to claim 1, wherein the silver halide contains 1–5 mol% of silver bromide.

* * * * *